United States Patent [19]

Gray

[11] 4,354,578

[45] Oct. 19, 1982

[54] READY CLAMP

[76] Inventor: Glenn E. Gray, R.F.D. No. 2, Tippecanoe, Ohio 44699

[21] Appl. No.: 204,267

[22] Filed: Nov. 5, 1980

[51] Int. Cl.[3] ..... B66B 5/00

[52] U.S. Cl. ..... 187/71; 24/134 L; 182/112

[58] Field of Search ..... 187/1 R, 71, 73, 89; 24/134 L, 134 KB, 134 KA, 134 KC, 134 R; 182/112

[56] References Cited

U.S. PATENT DOCUMENTS

| | | | |
|---|---|---|---|
| 473,275 | 4/1892 | Wakefield | 24/134 R |
| 674,708 | 5/1901 | Noble | 24/134 L |
| 928,367 | 7/1909 | DeWitt | 24/134 R |
| 1,002,947 | 9/1911 | Wallace | 187/71 |
| 1,334,925 | 3/1920 | Wilson | 24/132 R |
| 1,434,802 | 11/1922 | Bear | 24/134 L |
| 2,933,157 | 4/1960 | Huber | 188/65.1 |
| 3,386,530 | 6/1968 | Thompson | 182/112 |
| 3,967,349 | 7/1976 | Christensen | 24/134 KC |
| 4,077,094 | 3/1978 | Swager | 24/134 R |

FOREIGN PATENT DOCUMENTS

| | | | |
|---|---|---|---|
| 15890 | of 1904 | United Kingdom | 24/134 L |

*Primary Examiner*—Joseph J. Rolla
*Assistant Examiner*—Kenneth Noland
*Attorney, Agent, or Firm*—Cushman, Darby & Cushman

[57] ABSTRACT

A system and clamp for supporting a load such as an elevator in which the clamp is mounted on a cable above the load which is normally supported by and otherwise attached to the cable. The clamp supports the load in the event of failure of structure normally supporting the load between the clamp and load. The clamp includes two members defining between them an extending passage for the cable with one of the members being mounted for movement toward and away from the cable. A cam member is pivotably mounted with a cam surface at a variable radius from the pivot axis in engagement with the one member and attached by cable to the load to pivot and apply a force to the one member to frictionally lock the clamp to the cable and support the load in the event of failure.

10 Claims, 4 Drawing Figures

FIG. 3
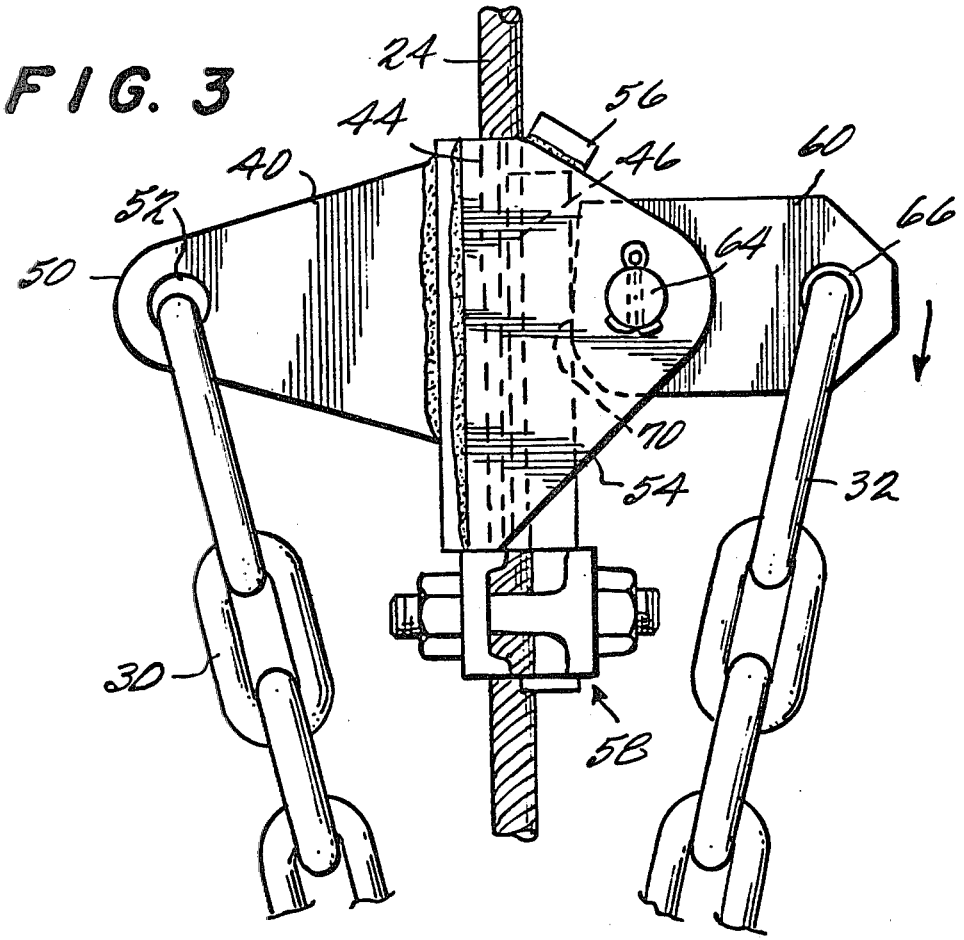
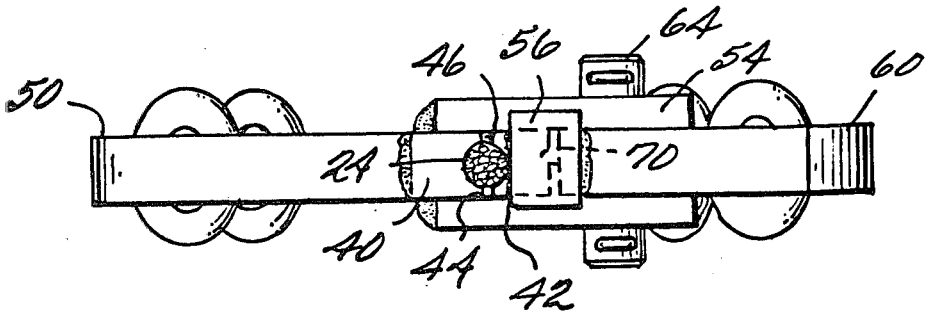
FIG. 4

READY CLAMP

BACKGROUND OF THE INVENTION

The invention relates to a system and clamp for supporting a load in the event of failure of the normal supporting structure between the clamp and the load.

For construction and other purposes, it is often useful to raise a load by means of a cable attached to a cage or some other load supporting structure. Particularly in a life supporting system in which personnel ride in the cage, it is desirable to provide some back-up system which will support the load in the event of failure of the cable or the attachment of the cable to the personnel cage. Such a failure can be due to errors of installing a main clamp, faulty materials, fatigue of the clamp or the cable, or damage to the cable caused by the main termination. Cable fatigue in particular happens almost always within three feet of the main termination.

According to the present invention, a clamp is provided on the cable above the point of attachment to the load supporting structure. The clamp includes first and second members having opposed curved surfaces defining therebetween an extending passage for the cable. One of the members is mounted for movement toward and away from the cable, for example, in a U-shaped channel provided by another member. A cam member is mounted outward from the cable for pivotable movement about an axis in a vertical plane. The cam member engages the one member which is movable toward and away from the cable, and also includes structure for attaching the cam member to the load remote from the axis of rotation, for example, by a chain. Failure of the cable or attachment thus causes the cam member to pivot about its axis, so that its surface applies an increasing force to the one member to frictionally lock the clamp to the cable and support the load.

The present invention has a number of advantages. It can be made of readily available materials such as steel, and is simple in construction. Its installation is simple, and it does not restrain the working of the cable. It does not preload the clamp or restrain the cable until failure and it lends itself to visual inspection. Readily available materials can be used to fabricate the clamp in a normal machine and fabricating shop. Location of the back-up clamp can be such that it will protect against almost all foreseeable failures.

Others in the past have sought to provide automatic safety catches. For example, the U.S. patent to Wallace No. 1,002,947, and the U.S. patent to Metheen No. 1,080,648, both show safety catch structure for elevators in which a wedge is used to lock the elevator to the cable in the event of failure. The present invention utilizes both friction and leverage with the advantages described above. The U.S. patent to Eck No. 498,161 describes eccentric cams which engage a safety cable and the U.S. Pat. to Wakefield No. 473,275 describes an elevator which may be secured for loading by a pair of tooth dogs. Other U.S. patents showing clamping to ropes include the patent to DeWit No. 92,837, the patent to Wilson No. 1,334,925, the patent to Hecker No. 1,947,603, the patent to Swager No. 4,077,094, the patent to Hubert No. 2,993,157, the patent to Thompson No. 3,386,530, and the patent to Christiensen No. 3,967,349.

Other objects and purposes of the invention will be clear from the following detailed description of the drawings.

BRIEF DESCRIPTION OF THE DRAWINGS

FIG. 3 shows a side view of the cable of the present invention in place on a cable; and FIG. 4 shows a top view of the clamp of FIG. 3.

DETAILED DESCRIPTION OF THE DRAWINGS

Figure 1:
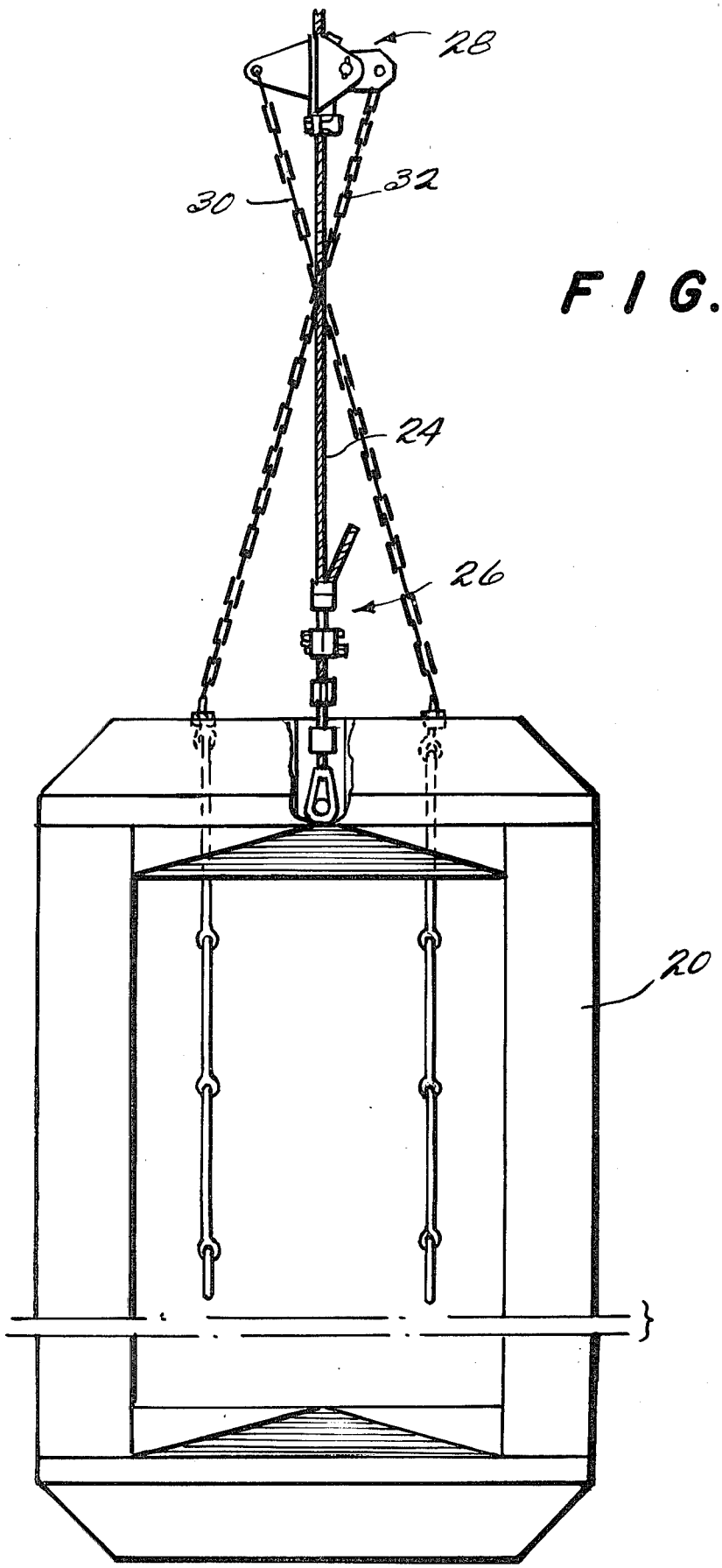
FIG. 1 shows a front view of the system of the present invention in use supporting a personnel cage with the door of the cage shown open.
Figure 2:
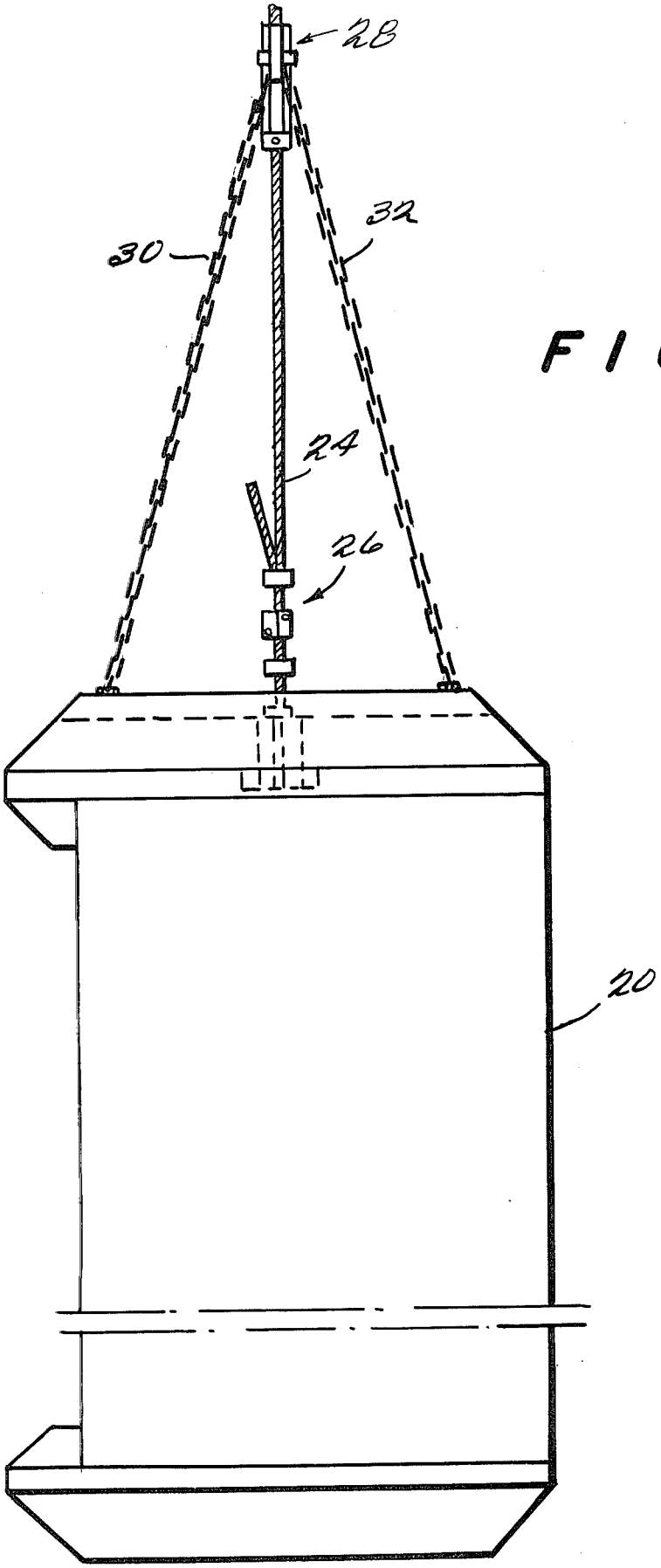
FIG. 2 shows a side view of the system of FIG. 1.

Reference is now made to FIGS. 1 and 2 which show the system and clamp of the present invention in use. A conventional elevator cage 20 supports a load, for example, one or more people who are to be raised and lowered. A conventional cable 22 of appropriate strength and size is attached to the top of case 20 by a conventional clamp arrangement generally indicated as 26. Above the point of attachment of cable 24 to cage 20, the clamp 28 of the present invention is provided. Clamp 28 is attached to cage 20 by respective chains 30 and 32, which cross as shown and which exert a force on clamp 28 to lock the clamp against cable 24 in the event of failure as described below.

Reference is now made to FIGS. 3 and 4 which illustrate the clamp of the present invention in detail. First and second members 40 and 42 are provided with opposing surfaces 44 and 46 which define between them an extending passage for cable 24. Member 40 has an extending portion 50 provided with a bore 52 to which the cable chain 30 can be conventionally attached. A further U-shaped channel member 54 is welded or otherwise permanently affixed to member 40 and mounts member 42 for movement in a vertical plane toward and away from cable 24. More particularly, a strut member 56 and a clamp indicated at 58 hold member 42 so that it is movable only in the vertical plane. Clamp 58 can be a simple double saddle cable clamp. A cam member 60 is pivotably mounted about axis 62 by means of pin 64 extending through matching bores in cam member 60 and channel member 54. A further bore 66 is provided remote from the point of pivoting for attachment of cable chain 32 so that in the event of failure of structure between clamp 28 and cage 20, cam member 60 is pivoted in the direction of the arrow. Since the radius of cam surface 70 from axis 62 increases in the opposite direction an increasing force is applied to member 42 forcing that member against cable 24 and frictionally locking clamp 28 to cable 24.

The structure is preferably made of heavy steel in an appropriate size to support whatever load is required.

Many changes and modifications in the above described embodiment of the invention can, of course, be made without departing from the scope thereof. Accordingly, that scope is intended to be limited only by the scope of the appended claims.

What is claimed is:

1. A clamp adapted to be mounted on a cable above a load normally supported by the cable for supporting the load from the cable in the event of failure of the cable supporting the load between the clamp and load comprising:

first and second members having opposed surfaces defining therebetween an extending passage for said cable, said first member being adapted for attachment to said load by attaching means connected to said first member at a location separated from said opposed surfaces;

means mounting said second member for movement toward and away from said cable;

a cam member mounted on said mounting means outward from said cable for pivotable movement in a vertical plane about an axis, said cam member having a cam surface at a radius from said axis which radius increases, said cam member engaging said second member and defining means remote from said axis for attaching said cam member to said load so that failure of said cable causes said cam member to pivot about said axis so that said cam surface applies a force to said second member to frictionally lock said clamp to said cable and support said load, said clamp being coupled to the cable in a non-fixed manner so that the clamp only applies a clamping force and is fixed coupled to the cable upon failure of the cable.

2. A clamp as in claim 1, wherein each said attaching defining means includes means defining a bore for attachment of a chain.

3. A clamp as in claim 1, wherein said opposed surfaces are curved.

4. A clamp as in claim 1, wherein said mounting means includes a third member having a U-shaped channel, means supporting said second member for movement in said channel, said third member and said cam member having bores extending therethrough along said axis, and a pivot member extending through said bores for permitting said pivotable movement.

5. A system for raising or lowering a load comprising:

means for supporting said load;

a cable attached to said load for supporting said load;

a clamp adapted to be mounted on a cable above a load normally supported by the cable for supporting the load from the cable in the event of failure of the cable supporting the load between the clamp and the load comprising first and second members having opposed surfaces defining therebetween an extending passage for said cable, said first member being adapted for attachment to said load by attaching means connected to said first member at a location separated from said opposed surfaces;

means mounting said second member for movement toward and away from said cable;

a cam member mounted on said mounting means outward from said cable for pivotable movement in a vertical plane mounting about an axis, said cam member having a cam surface at a radius from said axis which radius increases, said cam member engaging said second member and defining means remote from said axis for attaching said cam member to said load so that failure of said cable causes said cam member to pivot about said axis so that said cam surface applies a force to said second member to frictionally lock said clamp to said cable and support said load; and means for attaching said cam member to said load, said clamp being coupled to the cable in a non-fixed manner so that the clamp only applies a clamping force and is fixed coupled to the cable upon failure of the cable.

6. A system as in claim 5, wherein said load supporting means is an elevator cage.

7. A system as in claim 5, wherein said attaching means is a chain.

8. A system as in claim 5, wherein each said attaching defining means includes means defining a bore for attachment of a chain.

9. A system as in claim 5, wherein said opposed surfaces are curved.

10. A system as in claim 5, wherein said mounting means includes a third member having a U-shaped channel, means supporting said second member for movement in said channel, said third member and said cam member having bores extending therethrough along said axis, and a pivot member extending through said bores for permitting said pivotable movement.

* * * * *